US008307907B2

(12) United States Patent
Laskaris et al.

(10) Patent No.: US 8,307,907 B2
(45) Date of Patent: Nov. 13, 2012

(54) HYBRID FOAM PROPORTIONING SYSTEM

(75) Inventors: Michael A. Laskaris, Collegeville, PA (US); Dominic John Colletti, Royersford, PA (US)

(73) Assignee: Hale Products, Inc., Conshohocken, PA (US)

( * ) Notice: Subject to any disclaimer, the term of this patent is extended or adjusted under 35 U.S.C. 154(b) by 630 days.

(21) Appl. No.: 12/039,067

(22) Filed: Feb. 28, 2008

(65) Prior Publication Data

US 2009/0218110 A1 Sep. 3, 2009

(51) Int. Cl.
*A62C 2/00* (2006.01)

(52) U.S. Cl. ..... 169/44; 169/13; 169/14; 239/10; 239/124; 239/304; 239/305; 239/310; 239/413; 239/416.2; 239/417.5

(58) Field of Classification Search ..... 239/303–305, 239/307, 310–318, 329–334, 343, 349, 413, 239/416.2, 416.3, 417.5, 10, 124; 169/14–16, 169/13, 44
See application file for complete search history.

(56) References Cited

U.S. PATENT DOCUMENTS

| | | | | |
|---|---|---|---|---|
| 3,322,350 | A * | 5/1967 | Heinicke et al. | 239/172 |
| 5,284,174 | A * | 2/1994 | Norman | 137/5 |
| 5,427,181 | A | 6/1995 | Laskaris et al. | |
| 5,494,112 | A * | 2/1996 | Arvidson et al. | 169/13 |
| 5,960,887 | A * | 10/1999 | Crabtree | 169/15 |
| 5,996,700 | A | 12/1999 | Sulmone | |
| 6,138,767 | A | 10/2000 | La Vergne | |
| 6,357,532 | B1 | 3/2002 | Laskaris et al. | |
| 6,725,940 | B1 * | 4/2004 | Klein et al. | 169/15 |
| 6,991,041 | B2 | 1/2006 | Laskaris et al. | |
| 2006/0113405 | A1 | 6/2006 | Hubmann et al. | |

FOREIGN PATENT DOCUMENTS

| | | | |
|---|---|---|---|
| DE | 3817852 | C1 | 7/1989 |
| EP | 0978296 | A1 | 2/2000 |
| WO | 2004/010086 | A2 | 1/2004 |

OTHER PUBLICATIONS

EP09153410.7 Search Report issued Jun. 22, 2009.

New Zealand Examination Report for the related New Zealand Patent Application No. 575066 issued Feb. 26, 2009.

* cited by examiner

*Primary Examiner* — Christopher Kim

(74) *Attorney, Agent, or Firm* — Panitch Schwarze Belisario & Nadel LLP

(57) ABSTRACT

A hybrid foam system for providing a variety of proportioned foam solutions is provided. The system includes a low flow foam proportioning system operatively associated with a high flow foam proportioning system and a system controller for controlling the operating conditions of the overall hybrid foam system.

14 Claims, 9 Drawing Sheets

HYBRID FOAM PROPORTIONING SYSTEM

BACKGROUND OF THE INVENTION

The present invention generally relates to firefighting equipment, and more specifically, to a hybrid foam proportioning system for fighting fires.

The addition of foaming agents to fire fighting fluids or water streams is well known and can be particularly useful for fighting fires, for example, fires in industrial factories, chemical plants, petrochemical plants, petroleum refineries, forests, and structures. The use of fire fighting foam requires that a foam concentrate be mixed and added at constant proportions to the water stream. When the foam solution is delivered, the foam solution effectively extinguishes the flames of chemical, petroleum, and ordinary combustible fires which would otherwise not be effectively extinguished by the application of water alone.

Foam supply systems known in the art include CAFS (Compressed Air Foam System), WEPS (Water Expansion Pumping System), and EFPS (Electronic Foam Proportioning Systems). A typical foam proportioning system includes a foam injector system and a water pumping system. Whereas a typical CAFS includes a foam injector, a water pumping system, and an air system including an air compressor for supplying air under pressure. For example, when employing mixture ratios of 1/2 to 1 cubic feet per minute ("CFM") of air to 1 gallon per minute ("GPM") of water, these systems can produce very desirable results in fire fighting by the use of "Class A" or "Class B" foams to help achieve fire suppression and to deal with increased fire loads and related hazards.

Class A foams are also typically proportioned at 0.1% to 1.0% with an average of 0.4% to 0.5% foam chemical and most often used at flows below 1000 GPM (typically 150-250 GPM). However, Class B foams are proportioned at much higher rates of about 1% to 6% foam chemical typically at about 250 GPM per discharge line for larger hazards. Therefore, for a high flow Class B foam, a much higher foam proportioning capacity is required. However, typical electrical systems on fire apparatus, such as a fire engine, can only support up to a 6 GPM electric pump system. While such systems are suitable for Class A foams, which typically require up to 1.25 GPM of Class A foam concentrate to treat up to 250 GPM of water, such systems are not suited for Class B applications which require about 7.5 GPM or more of foam concentrate to treat about 250 GPM water for a 3% foam chemical. This is where the venturi based, high flow hybrid foam system of the present embodiment advantageously provides the necessary high flow Class B firefighting foam. Class A and Class B relate to fire classes A and B. Class A fires typically involve burning wood whereas Class B fires involve liquid combustible fuels.

Conventional foam proportioning systems typically utilize venturi based proportioning technology. Venturi devices are known proportioning devices creating pressure drops that vary with fluid flow rate in order to proportion foam concentrate into a fire fighting fluid conduit in accordance with varying fire fighting fluid flow rates. Conventional venturi devices accomplish this task with a certain degree of accuracy and efficiency at a fixed flow. In general, the greater the fire fighting fluid flow rate the greater the pressure drop through the venturi, thus drawing in a greater amount of foam concentrate. However, such venturi devices alone are not accurate at low flow rates and their efficiency decreases with high flow rates. The efficiency drops because total pressure drop is in proportion to flow rate and pressure recovery downstream is limited to a maximum efficiency range in the order of 65% to 85% of the pressure drop. Thus, the higher the flow rate, the greater the pressure drop, the less the pressure recovery and the more limited the efficiency. Moreover, conventional venturi devices are not controllable by a user so that such inefficiencies and under or over proportioned foam solutions result due to out-of-control operating conditions of the venturi. Additionally, in a conventional system, the operator has no feedback for adjustment of flow or backpressure which are critical operational parameters for venturi (also know as an eductor) operation. Too much back pressure, for instance will lower or stop foam flow.

The cost of most high volume foam proportioning systems render such systems cost prohibitive for average local fire departments, especially considering that most fires handled by local fire departments are Class A or very small Class B fires, which do not require the assistance of high volume foam proportioning systems. Although smaller foam proportioning systems do exist, such as discharge side pump proportioning systems, such smaller systems do not have the capacity for large Class B fires. As a result, when large Class B fires do arise, under equipped fire departments usually require assistance from other fire departments that may have specialty foam, air port, military, or industrial foam units, or the larger fire burns uncontrolled until enough fuel is consumed that the fire is small enough to be extinguished by the smaller equipment the fire department has in service, obviously creating additional damage and risk. Accordingly, there is a need for a simple, easy to use, controllable foam system that can be readily used for low volume Class A fires and easily converted to a reliable high volume Class B foam flow for Class B fires.

BRIEF SUMMARY OF THE INVENTION

The present invention provides for a hybrid foam system comprising: a low flow foam proportioning system; a high flow foam proportioning system operatively associated with the low flow foam proportioning system; a water source connected to the low flow and high flow foam proportioning systems; and a system controller operatively in communication with the low flow and high flow foam proportioning systems.

The present invention also provides for a method of producing a variety of foam solutions comprising the steps of: providing a low flow foam proportioning system; providing a high flow foam proportioning system operatively associated with the low flow foam proportioning system; and providing a system controller operatively associated with the low flow and high flow foam proportioning systems for controlling the operation of the low flow and high flow foam proportioning systems.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments of the invention which are presently preferred. It should be understood, however, that the invention is not limited to the precise arrangements and instrumentalities shown.

In the drawings.

DETAILED DESCRIPTION OF THE INVENTION

Figure 1:
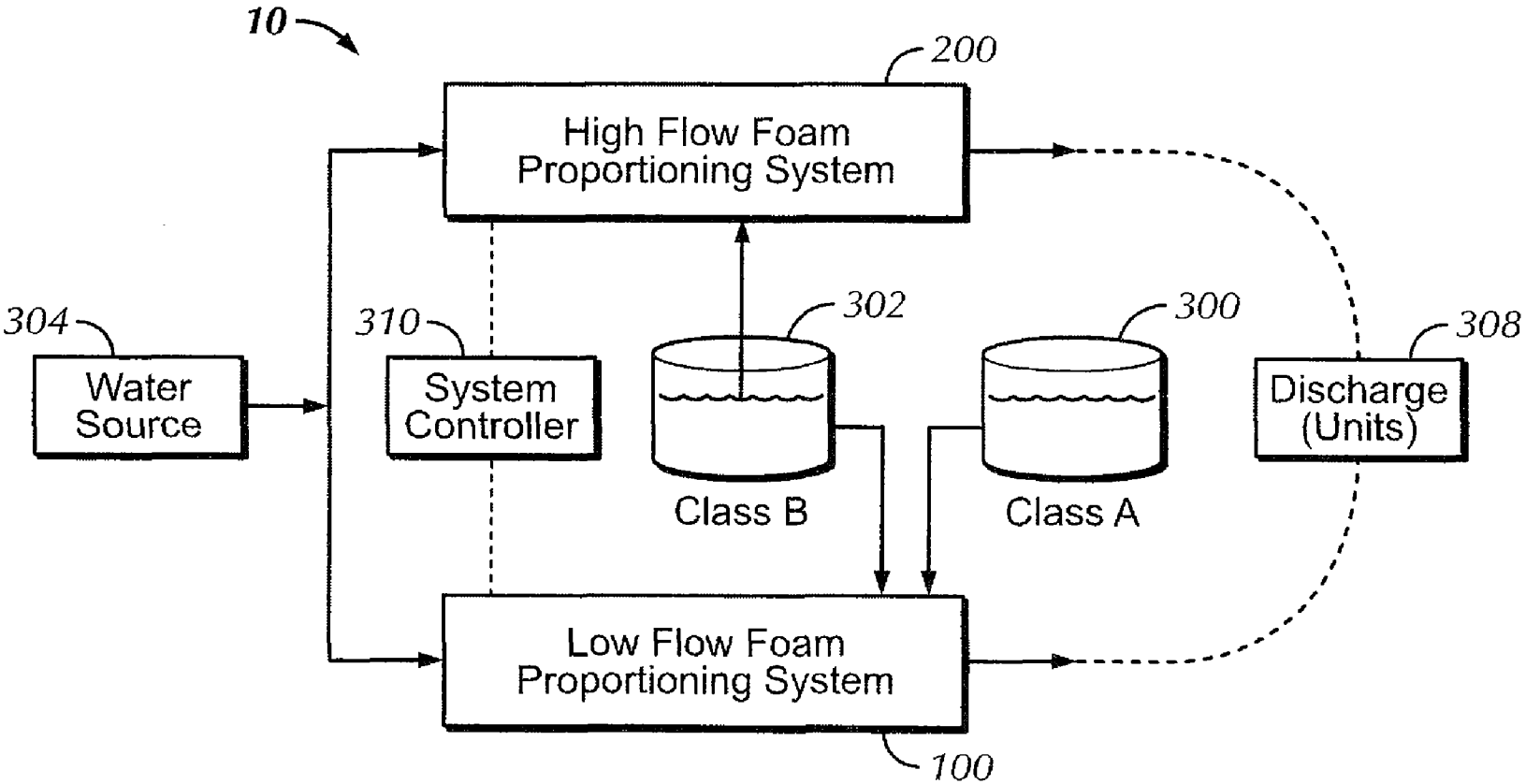
FIG. 1 is a schematic illustration of a preferred embodiment of a hybrid foam system in a parallel configuration.

Certain terminology is used in the following description for convenience only and is not limiting. The words "right," "left," "lower," and "upper" designate directions in the drawings to which reference is made. The words "inwardly" and "outwardly" refer to directions toward and away from, respectively, the geometric center of the foam systems and designated parts thereof. The terminology includes the words above specifically mentioned, derivatives thereof and words of similar import. Additionally, the word "a," as used in the claims and in the corresponding portions of the specification, means "at least one."

Figure 2:
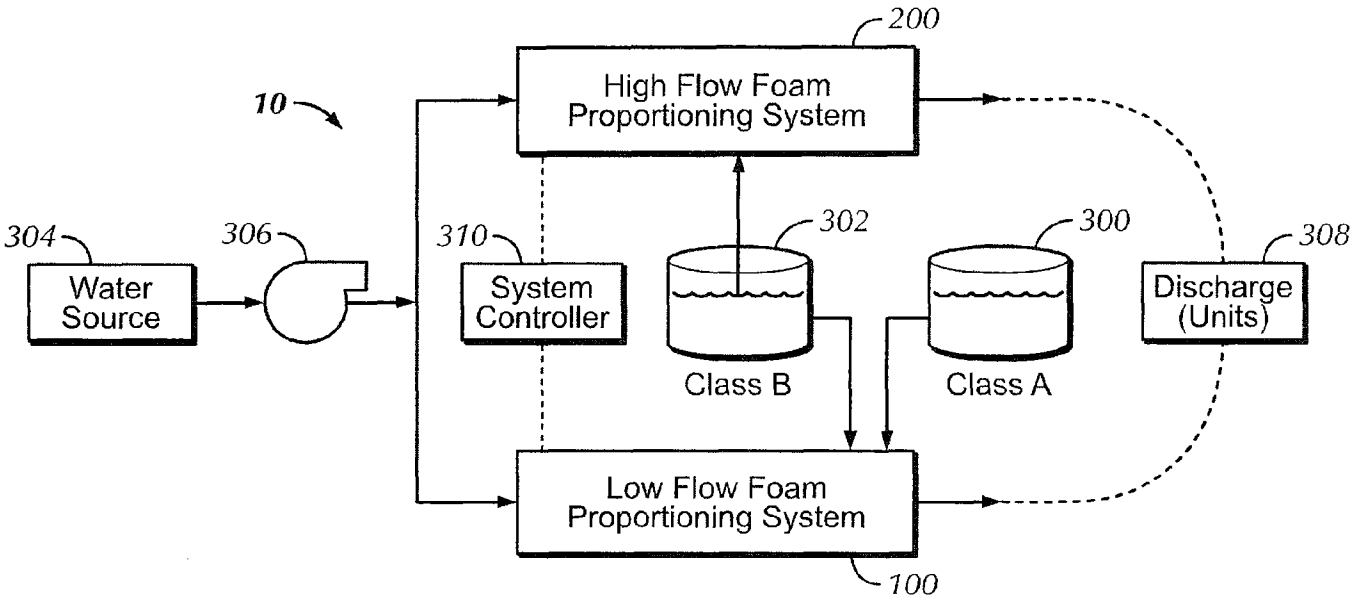
FIG. 2 is a schematic illustration of the preferred embodiment in FIG. 1 that includes a water pump.
Figure 3:
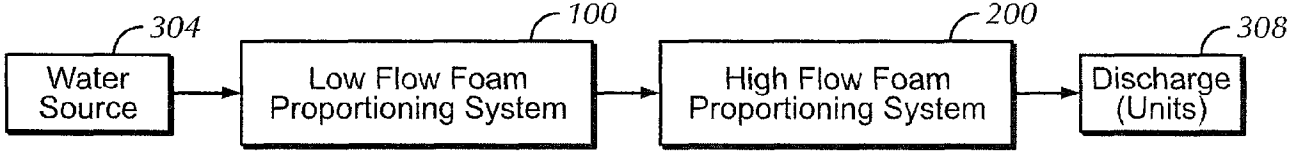
FIG. 3 is a schematic illustration of a preferred embodiment of a hybrid foam system in a series configuration.

In an embodiment as shown in FIG. 1, the present invention provides for a hybrid foam system 10. The hybrid foam system 10 includes a low flow foam proportioning system 100, a high flow foam proportioning system 200, a Class A foam tank 300, a Class B foam tank 302, a discharge unit 308, and a system controller 310. The hybrid foam system 10 can optionally include a water pump 306 for providing additional water pressure to the high flow 200 and low flow 100 foam proportioning systems from a water source as shown in FIG. 2. The water source 304, can be a fire hydrant, fire truck, water tower, stand pipe or any other source for providing water and water pressure through the hybrid foam system 10. The low flow 100 and high flow 200 foam proportioning systems can be configured in a parallel configuration (as shown in FIG. 1) or in a series configuration (as shown in FIG. 3). It is to be understood that while the present embodiment is described with respect to Class A and Class B foam tanks, any number of foam tanks containing any class of fire fighting foam to be within the scope of the present embodiment.

Figure 4:
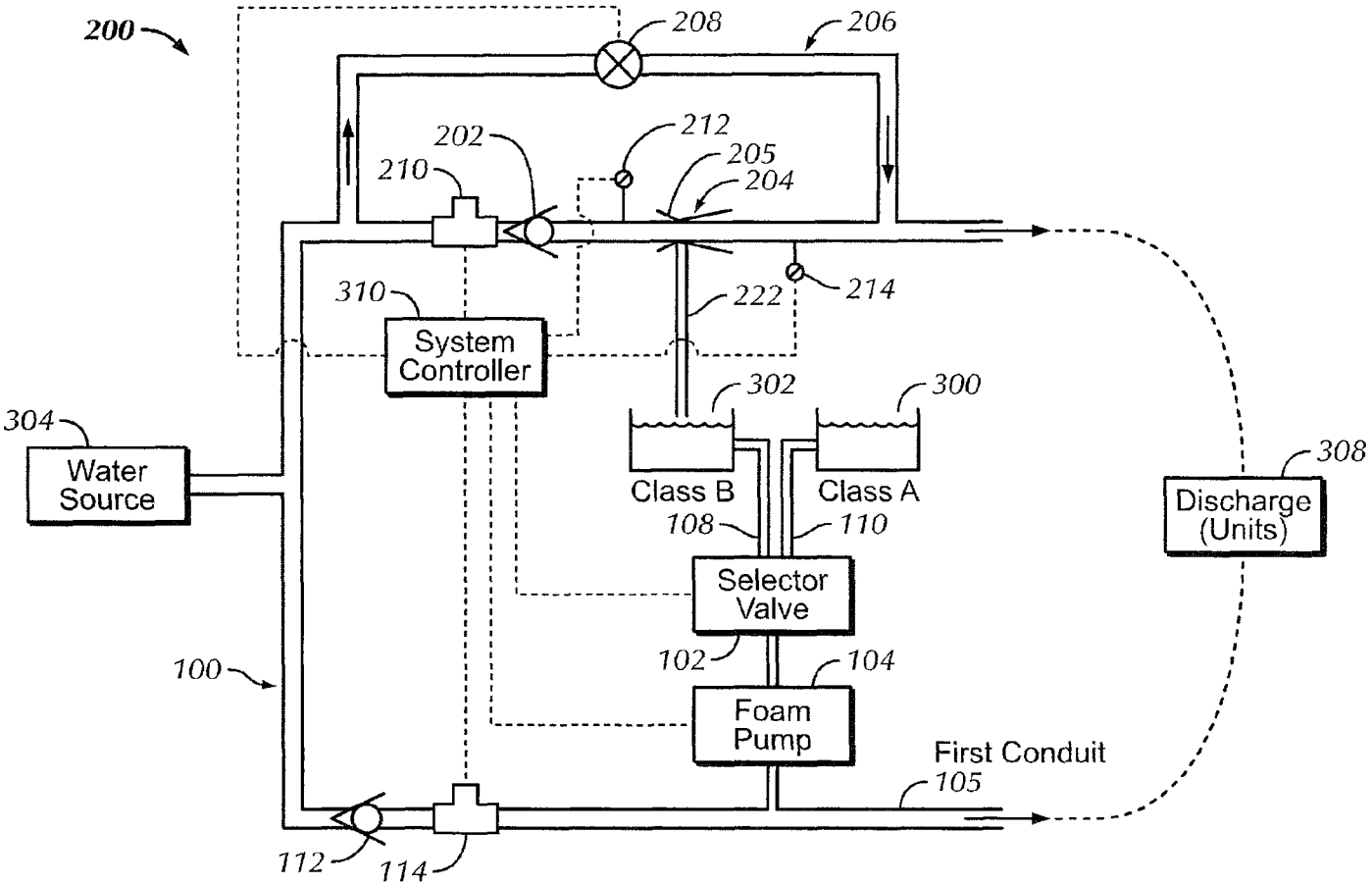
FIG. 4 is a detailed schematic illustration of the hybrid foam system of FIG. 1.

The low flow foam proportioning system 100 can be any conventional foam proportioning system such as a Foam-Logix® Electronic Foam Proportioning System from Hale Products Inc, of Conshohocken, Pa., a compressed air foam system, or similar electronic discharge side foam proportioning system that does not, by itself, have the capacity for large Class B foam flow. The low flow foam proportioning system 100, as shown in FIG. 4 includes a selector valve 102 and a foam pump 104, each operatively in communication with the system controller 310, and a first conduit 105. The selector valve 102 of the low flow foam proportioning system 100 is connected to the Class B foam tank 302 and the Class A foam tank 300 by connection lines 108 and 110. The connection lines 108, 110 can be any connection means readily known in the art such as piping, hoses, etc. sufficient for its intended use.

The foam pump 104 operates to pump either Class A or Class B foam (depending on the setting of the selector valve 102) from the respective tanks 300, 302 to the first conduit 105. The first conduit 105 provides a fluid path between the water source 304, the foam pump 104, and the discharge unit 308. The foam pump 104 can also include a foam pump flow meter (not shown) to provide real time feedback to the system controller 310 on the rate of foam flow to the first conduit 105. A typical foam pump 104 is capable of pumping about 5.0 gallons per minute (GPM).

Operation of the selector valve 102 is used to determine whether Class A or Class B foam is pumped at any given time. The selector valve 102 and foam pump 104 are both operatively connected to the system controller 310 that can automatically control the type and rate of foam being pumped in response to an input, such as an operator input, to advantageously provide a more accurate percentage foam solution.

The low flow foam proportioning system 100 can optionally include a check valve 112 and a water flow sensor 114 operatively in communication with the system controller 310. Overall, the system controller 310 is preferably configured to be operatively in communication with the selector valve 102, the foam pump 104, and the water flow sensor 114. To control the overall concentration of the foam solution discharge, the system controller 310 is used to control the foam pump 104 which regulates the amount of foam concentrate from the foam tanks to the first conduit 105.

Figure 5:
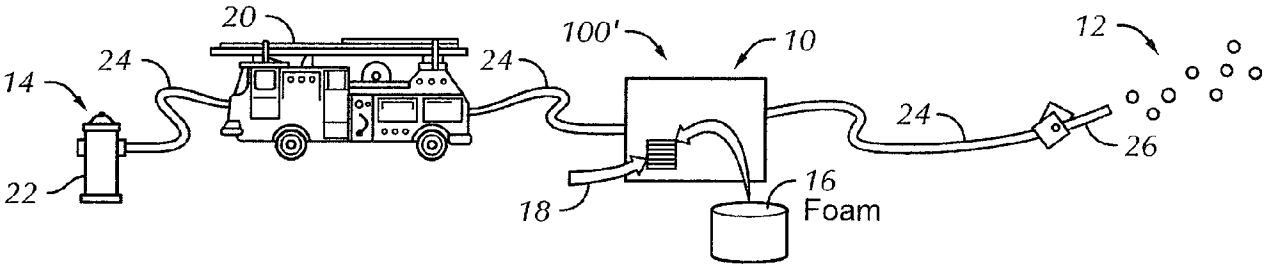
FIG. 5 (Prior Art)
FIG. 5 is a schematic illustration of a prior art compressed air foam system of a preferred embodiment of the present invention.

In another embodiment, the low flow foam proportioning system 100 can be a conventional compressed air foam system 100' as shown in FIG. 5 and as described in U.S. Pat. No. 6,357,532, the disclosure of which is hereby incorporated by reference. The compressed air foam system 100' is a self contained module that adds foam chemical or foam concentrate 16 and air 18 to a water flow 14 to make a compressed air foam solution 12 i.e., a foam solution 12. When combined in the proper ratios the compressed air foam solution 12 is better at suppressing fire than plain water alone. This means that a plain water flow from any water pumping device (such as a fire truck 20) or a hydrant 22 of sufficient flow and pressure can be used to generate compressed air foam 12 by running the water through the compressed air foam system 100'. Fire hose 24 can be used to connect the compressed air foam system 100' to the source of supply water and to a discharge unit such as a nozzle 26 or a plurality of nozzles (not shown) operated by a fireman for delivery of the foam solution 12 to the fire.

Various foam chemicals 16 can be used with the low flow foam proportioning system 100 or the high flow foam proportioning system 200 to generate the foam solution 12. For firefighting purposes, the foam chemical 16 generally refers to firefighting foam chemical additives of the Class A or B variety. These firefighting foam chemicals are generally known in the art and used in the firefighting service and a detailed description of such foam chemicals is not necessary for a complete understanding of the present invention. While foam chemicals are presently preferred, it is to be understood that any chemical additive capable of facilitating fire suppression to be within the scope of the present embodiment.

Figure 6:
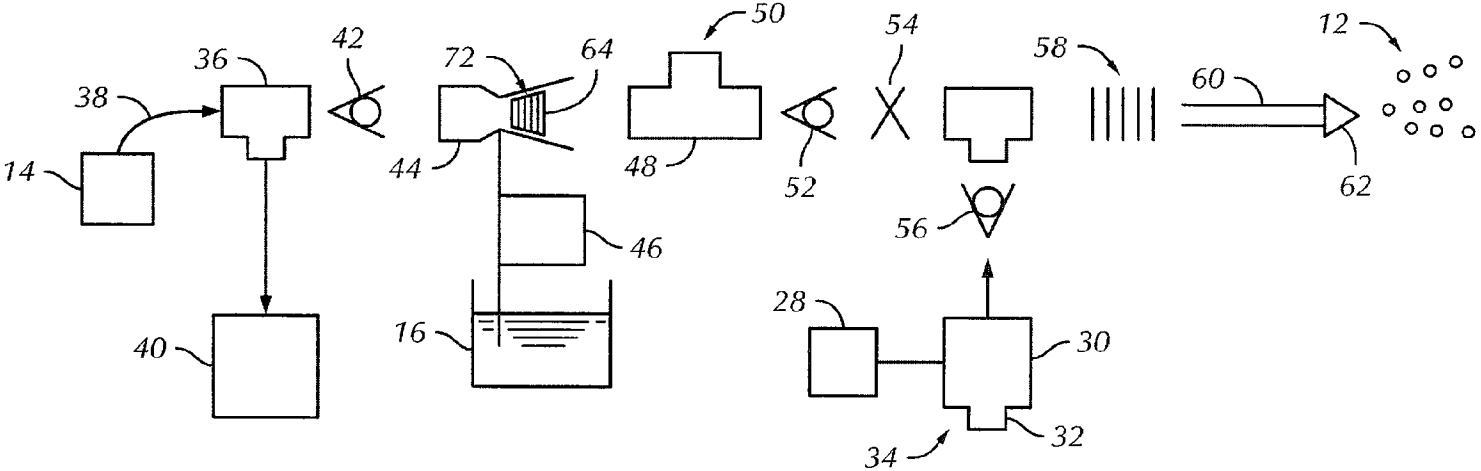
FIG. 6 (Prior Art)
FIG. 6 is a detailed schematic illustration of the prior art compressed air foam system of FIG. 5.

Referring to FIGS. 5 and 6, the compressed air foam system 100' has a power source 28 or is connected to a power source 28. The power source 28 can be any conventional power source readily known in the art and suitable for its intended purpose. Exemplary power sources 28 include a Briggs and Stratton 18 horsepower gasoline engine, a gas or diesel power source, an electric motor or hydraulic drive system, and a power take-off drive from a gear box or a fire truck transmission.

The power source 28 is operatively coupled to an air compressor 30 and provides sufficient power and speed to run the air compressor 30. The air compressor 30 typically runs at a constant speed in the compressed air foam system 100'. The air compressor 30 can be a rotary compressor, a reciprocating type compressor, or any other compressor readily known in the art.

The air compressor 30 is fitted with an intake throttling valve 32 which allows control of the air discharge pressure from the air compressor 30 by throttling the air intake of the compressor 30 at an air inlet 34. Suitable air intake throttling valves 32 are available from AirCon, Erie, Pa. Decreasing the air flow into the air compressor 30 reduces the airflow out of the air compressor 30. This allows the outlet air pressure to be controlled across any compressor discharge orifice. The air intake valve 32 can be pilot operated and controlled by a pilot regulator, such as those available from AirCon, Erie Pa., in a fashion common to industrial compressors.

Water 14 from a water source enters the compressed air foam system 100' at a water inlet 36 and passes through a water flow path 38 through the compressed air foam system 100'. A portion of the water flow in the compressed air foam system 100' can be bled off and fed to a heat exchanger 40, such as a water to oil heat exchanger, to cool the air compressor 30. The water 14 leaving the heat exchanger 40 can be fed to any desired location, such as back to a water tank on the fire truck, for example. The water 14 provided to the heat exchanger 40 does not contain the foam chemical 16.

The water 14 flows from the water inlet 36 through a check valve 42 to prevent any foam chemical 16 from back flowing into the water source 14 or the heat exchanger 40. The water 14 next enters a water and foam chemical mixer 44 to mix together the water 14 and foam chemical 16. The foam chemical 16 may be fed into the water and foam chemical mixer 44 by a pump 46. In the water and foam chemical mixer 44, the foam chemical 16 is added in the correct proportion to the water flow. Typically Class A foam chemical is added at about 0.1 to 1.0 percent by volume foam chemical.

The foam solution (i.e., foam chemical and water solution) is then passed through a tee 48 to provide plain foam solution 50 to specified firefighting discharges, if desired. The remaining foam solution 50 passes through another check valve 52 to prevent backflow of compressed air foam solution 12 into the foam solution lines. A ball valve 54 controls the rate but does not shut off the foam solution flow. After the ball valve 54 the air is injected from an air outlet of the air compressor 30 through an air discharge check valve 56. The foam solution can then be turned into the compressed air foam solution 12 using for example, motionless mixers 58, such as those described in U.S. Pat. No. 5,427,181 to Laskaris et al., the disclosure of which is hereby incorporated by reference. The finished compressed air foam solution 12 is routed to one or more hose lines 60 with shut off valves 62 (such as a nozzle) for controlling the application of the compressed air foam on the fire.

The compressed air foam system 100' can utilize a control system (not shown) which may be constructed of mechanical relays, electronic circuits, a computer, combinations thereof or any other control system readily known in the art.

If a water flow signal indicates that no water is flowing from the water source 14, the control system can completely close the air intake valve 32 on the compressor 30 which will stop the flow of air. Water cannot flow from the mixer 58 back into the compressor 30 because the air discharge check valve 56 shuts as soon as the air flow from the compressor 30 stops. Reducing the discharge pressure of the air compressor 30 places less load on the engine used to run the compressor 30, such as a small air cooled engine, when no air flow is required.

Additional sensors (not shown) can also be included in the control system to control the air flow into and out of the compressor 30. The sensors detect a particular parameter and have a parameter signal indicative of the parameter. The control system utilizes the parameter signals to actuate the air flow controller 32 based on the parameter signals.

Figure 7:
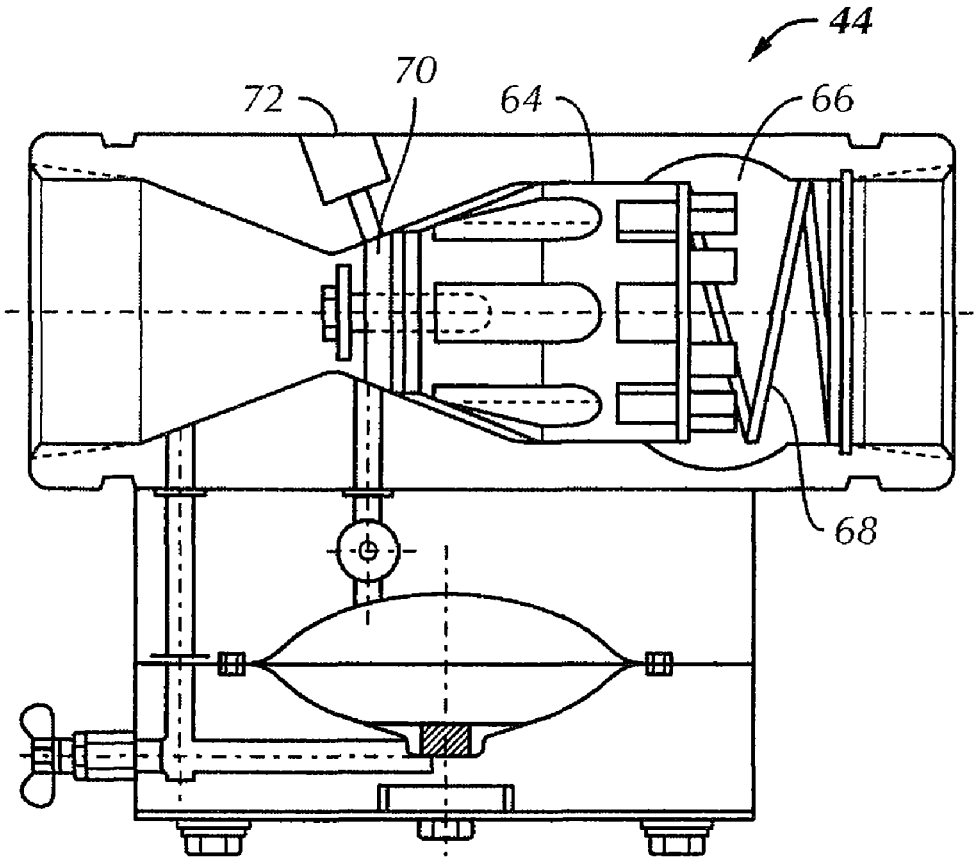
FIG. 7 (Prior Art)
FIG. 7 is a side schematic illustration of the prior art foam proportioner of FIG. 5.

Referring to FIG. 7, the water and foam chemical mixer 44 (i.e., a foam proportioning device) is shown in greater detail. The water and foam chemical mixer 44 contains a non-metallic piston 64 that resides inside a non-ferrous venturi 66. The piston 64 displacement against a spring 68 is caused by water flow and can be utilized for sensing water flow. The piston 64 has a portion which is a corrosion resistant magnetic alloy, such as a stainless steel washer 70. An inductive proximity switch 72 can also be used to sense the position of the piston 64 by sensing the metallic portion 70. The amount of water flow can be determined by knowing the position of the piston 64 in the water and foam chemical mixer 44. The water flow signal from the proximity sensor 72 can be used to trip a solenoid that sends a signal to the intake valve 32 on the air compressor 30 to adjust the air intake. In this manner, the output pressure of the air compressor 30 can be controlled.

In another embodiment, the low flow foam proportioning system 100 can be a conventional electronic foam proportioning system (not shown). Exemplary foam proportioning systems are described in U.S. Pat. No. 5,996,700, entitled Foam Proportioner System, which is hereby incorporated by reference in its entirety.

Referring back to FIG. 4, the high flow foam proportioning system 200 includes a control valve 202, a venturi based foam proportioner 204, a bypass conduit 206, and a bypass valve 208. The bypass conduit 206 in conjunction with the bypass valve 208 is configured to divert the complete or partial flow of water from the venturi based foam proportioner 204 to the discharge unit 308. As such, the high flow foam proportioning system 200 can advantageously be operated to provide a high output water stream or a foam solution, such as a Class B foam solution. Moreover, the bypass conduit 206 advantageously allows for additional control of the amount of foam being proportioned by operation of the bypass valve 208 that indirectly controls the amount of water flowing through the venturi 204. The high flow foam proportioning system 200 can optionally include an inlet flow sensor 210, an inlet pressure sensor 212, and an outlet pressure sensor 214.

Figure 8:
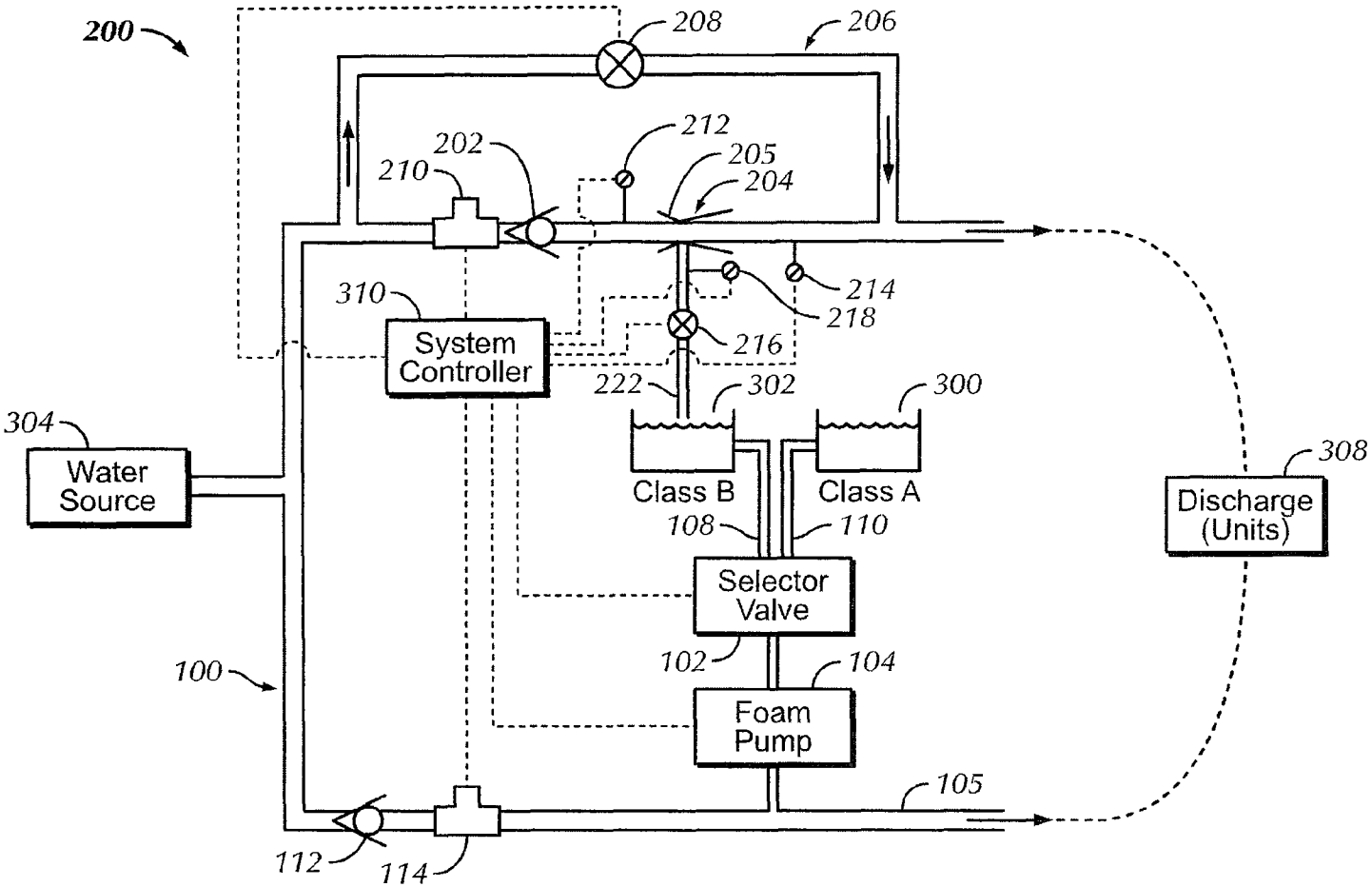
FIG. 8 is a schematic illustration of another embodiment of a hybrid foam system in a parallel configuration.

In a preferred embodiment as shown in FIG. 8, the high flow foam proportioning system 200 can include a foam inlet valve 216 and a foam inlet pressure sensor 218. The foam inlet pressure sensor 218 is preferably disposed upstream from the foam inlet valve 216 to sense the pressure of foam concentrate as it is being transferred from the foam tank 302 to the venturi based foam proportioner 204. The pressure sensor 218 can provide feedback as to the amount of foam concentrate flow entering the venturi based foam proportioner 204. Thus, the sensor 218 can advantageously provide feedback to the system controller 310 to indicate if the high flow foam proportioning system 200 is operating within the correct range to produce the proper percentage of foam concentrate to water solution. The foam inlet pressure sensor 218 and foam inlet valve 216 can be independently and operatively in communication with the system controller 310. Inlet valves, such as the foam inlet valve 216, a restrictor valve, etc., are readily known in the art and a detailed explanation of their structure and function is not necessary for a complete understanding of the present embodiment.

Referring back to FIG. 4, the venturi based foam proportioner 204 is connected to the Class B foam tank 302 by connection line 222. The Class B foam tank 302 can be the same Class B foam tank 302 as used by the low flow foam proportioning system 100 or a separate stand alone Class B foam tank (not shown). In an alternative embodiment, the venturi based foam proportioner 204 can be connected to both the Class B foam tank 302 and the Class A foam tank 300 with a selector valve (not shown) similar to the selector valve 102 of the low flow foam proportioner 100.

Figure 9:
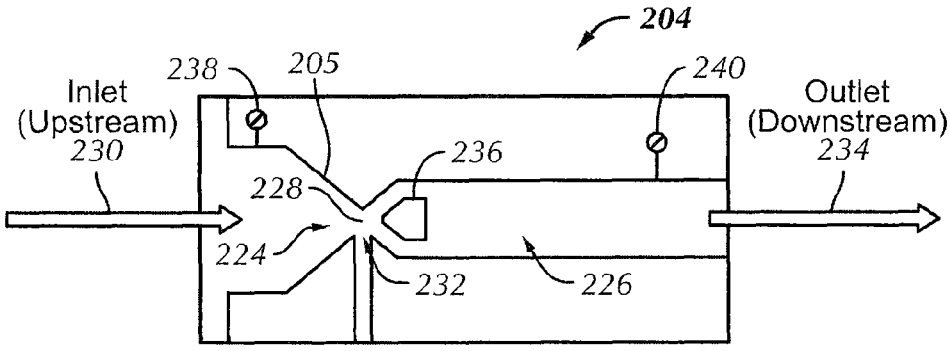
FIG. 9 is a schematic illustration of a venturi based foam proportioner of the embodiment in FIG. 4.

As shown in greater detail in FIG. 9, the venturi based foam proportioner 204 includes a venturi 205 that has a converging section 224, a diverging section 226, a vena contracta 228, a liquid inlet 230 configured to receive a flow of a liquid (e.g., a fire fighting fluid) upstream from the converging section 224, a foam inlet 232 configured for receiving a flow of a foam concentrate, an outlet 234 for the exit of the foam solution downstream from the diverging section 226, and a piston 236 operatively associated with the venturi 205.

The liquid inlet 230 is configured to receive the flow of a liquid upstream from the converging section 224, for example, for receiving the flow of liquid from the low flow foam proportioning system 100 or a water source 304 such as a fire truck 20 or a water hydrant 22. The foam inlet 232 is configured for receiving a flow of a foam chemical or foam concentrate from, for example, a foam tank 302. The outlet 234 is configured for the exit of the liquid and foam flow i.e., foam solution downstream from the diverging section 226. The outlet 234 can then be connected to a discharge unit 308 such as a fire hose with shut off valves for use on fires.

The venturi based foam proportioner 204 is preferably configured with first 238 and second 240 pressure sensors. The first pressure sensor 238 is disposed upstream of the converging section 224 for sensing upstream pressure. The second pressure sensor 240 is disposed downstream of the diverging section 226 for sensing downstream pressure. The pressure sensors can be any conventional pressure sensors such as a Wheatstone bridge strain gauge pressure sensor or a variable capacitance pressure transducer such as those manufactured by GEMS. Alternatively, any conventional flow meter or flow sensor can be used instead of or in combination with the pressure sensors 238, 240. Each pressure sensor can be independently in communication with the system controller 310.

In a preferred embodiment, the venturi based foam proportioner 204 is configured to allow a flow of about 250 GPM of fire fighting fluid. The foam concentrate is proportioned with the fire fighting fluid at a rate of about 0.1% to about 6% by volume foam concentrate and more preferably at a rate of about 2.5% to about 3.5% by volume foam concentrate. The venturi based foam proportioner 204 can also be configured to proportion about 15 GPM of foam with the fire fighting fluid.

The piston 236 in combination with the venturi 205 allows for higher velocities at lower flow rates by occluding the area of the vena contracta 228 in the venturi 205. The overall result is a variable area venturi that can create increased local velocities which in turn can increase the negative pressure and thus increase the amount of foam concentrate injected at low inlet flow rates. This advantageously allows for the production of Class B foam from low volume flow pumping systems.

The piston 236 is configured to move axially along the diverging section 226 of the venturi 205 toward or away from the vena contracta 228 and its position can be controlled by the system controller 310. Such pistons are readily known in the art and a detailed description of them is not necessary for a complete understanding of this embodiment. Alternatively the piston 236 can be configured to be balanced against its own drag force through the use of a spring (such as shown in FIG. 7). The position of the piston 236 operates to control the pressure differential between the converging 224 and diverging sections 226 of the venturi 205. This controllable pressure differential advantageously allows for greater pressure differences at low inlet flow rates and therefore higher outlet flow rates. The rate of flow through the venturi 205 also effects that amount of foam concentrate received through the foam inlet 232. As fluid flows through the venturi 205, the pressure drop created withdrawals or "sucks" the foam concentrate from the foam tank 302, which is typically maintained at atmospheric pressure, into the fire fighting fluid stream.

Referring back to FIG. 4, the high flow foam proportion system 200 is operatively associated with the low flow foam proportioning system 100. For example, the high flow foam proportioning system 200 can be connected with the low flow foam proportioning system 100 such that the high flow foam proportioning system 200 operates in parallel with or in series with the low flow foam proportioning system 100. FIG. 4 illustrates the hybrid foam system 10 configured with the high flow foam proportioning system 200 connected in parallel with the low flow foam proportioning system 100. FIG. 3 illustrates the hybrid foam system 10 configured with the high flow foam proportioning system 200 connected in series with the low flow foam proportioning system 100.

The system controller 310 is configured to be operatively in communication with the low flow foam proportioning system 100 and the high flow foam proportioning system 200 for controlling the overall operation of the hybrid foam system 10. Preferably, the system controller 310 is configured to be operatively in communication with the bypass valve 208, inlet flow sensor 210, inlet pressure sensor 212, outlet pressure sensor 214, foam inlet valve 216, foam inlet pressure sensor 218, and the first and second pressure sensors 238 and 240 of the venturi-based foam proportioner 204.

Figure 10:
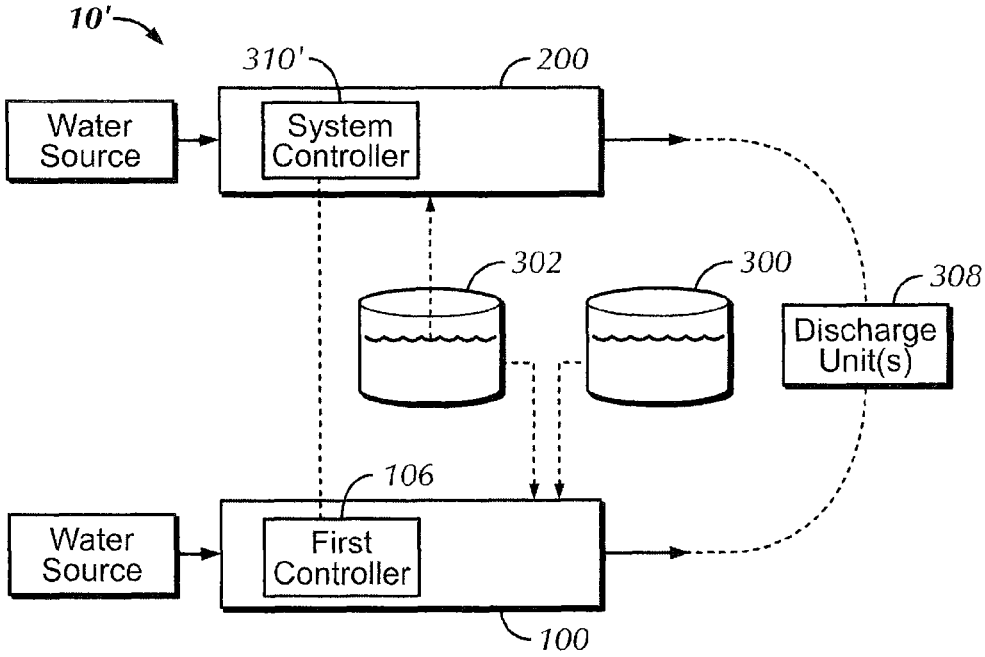
FIG. 10 is a schematic illustration of a preferred embodiment of a modular hybrid foam system of the present invention.

In another embodiment, the low flow 100 and high flow 200 foam proportioning systems are configured as a modular hybrid foam system 10' as shown in FIG. 10. In this embodiment, the low flow foam proportioning system 100 can operate as a stand alone unit having its own first controller 106. The high flow foam proportioning system 200 can also function as a stand alone unit having its own system controller 310'. However, the low flow 100 and high flow 200 foam proportioning systems are configurable such that the system controller 310' can be operatively in communication with the first controller 106. As such, the present embodiment advantageously provides for a modular hybrid foam system 10' that can function to provide Class A foam solution for class A fires and high volume Class B foam solution for class B fires.

Referring back to FIG. 4, the system controller 310 can be, for example, a programmable logic controller or a computer that includes a display for displaying various operating parameters. Such control systems are commonly known in the art and a detailed description of them is not necessary for a complete understanding of the present invention. However, exemplary controllers can include a computer, a programmable logic controller (PLC), pneumatic controllers, mechanical relays, etc. Preferably, the various operating parameters are displayed in a graphical mode such as a colored bar graph to illustrate when the system is no longer operating within standard operating parameters and no longer functioning at optimal conditions. A graphical display mode advantageously allows an operator to quickly visually check if the system is not functioning properly or needs to be adjusted as opposed to a numerical display, especially when being used in a busy fire fighting situation. Typical parameters to be displayed on the display can include fire fighting fluid flow rate, pump pressure, and back pressure. The system controller 310 can also be configured with a set of stored instructions for automatically controlling the low flow 100 and high flow 200 foam proportioning systems to maintain a desired proportion of foam concentrate to fire fighting fluid volume. Such instructions can be stored as a computer program, in a microprocessor, or through logic controls (e.g., via ladder logic).

In a preferred embodiment, the system controller 310 controls the foam solution percentage discharged from the low flow foam proportioning system 100 by controlling the foam pump 104 which controls the rate of foam concentrate flow to the first conduit 105. Moreover, the system controller 310 can automatically adjust the rate of foam concentrate flow in response to feed back from a foam pump flow meter (not shown). The system controller 310 controls the foam solution percentage discharged from the high flow foam proportioning system 200 by controlling the rate of flow of water into the venturi 204 by controlling the control valve 202. The rate of flow of water passing through the venturi 204 directly controls the amount of foam concentrate entering the venturi 204 and mixing with the water flow to form the foam solution. Moreover, the system controller 310 can automatically adjust the rate of foam concentrate flow in response to feed back from the foam inlet pressure sensor 218. This is accomplished by the system controller 310 automatically adjusting the control valve 202 or the foam inlet valve 216.

The hybrid foam system 10 advantageously provides operational feedback, such as inlet and outlet pressures and flow rates, to an operator or a system controller such that modifications can be made semi-automatically or automatically to operate the hybrid foam system 10 within its optimal parameters. Thus, the quality of foam solution available to fire fighters will not be compromised due to foam proportioning systems operating out of specification.

Figure 11:
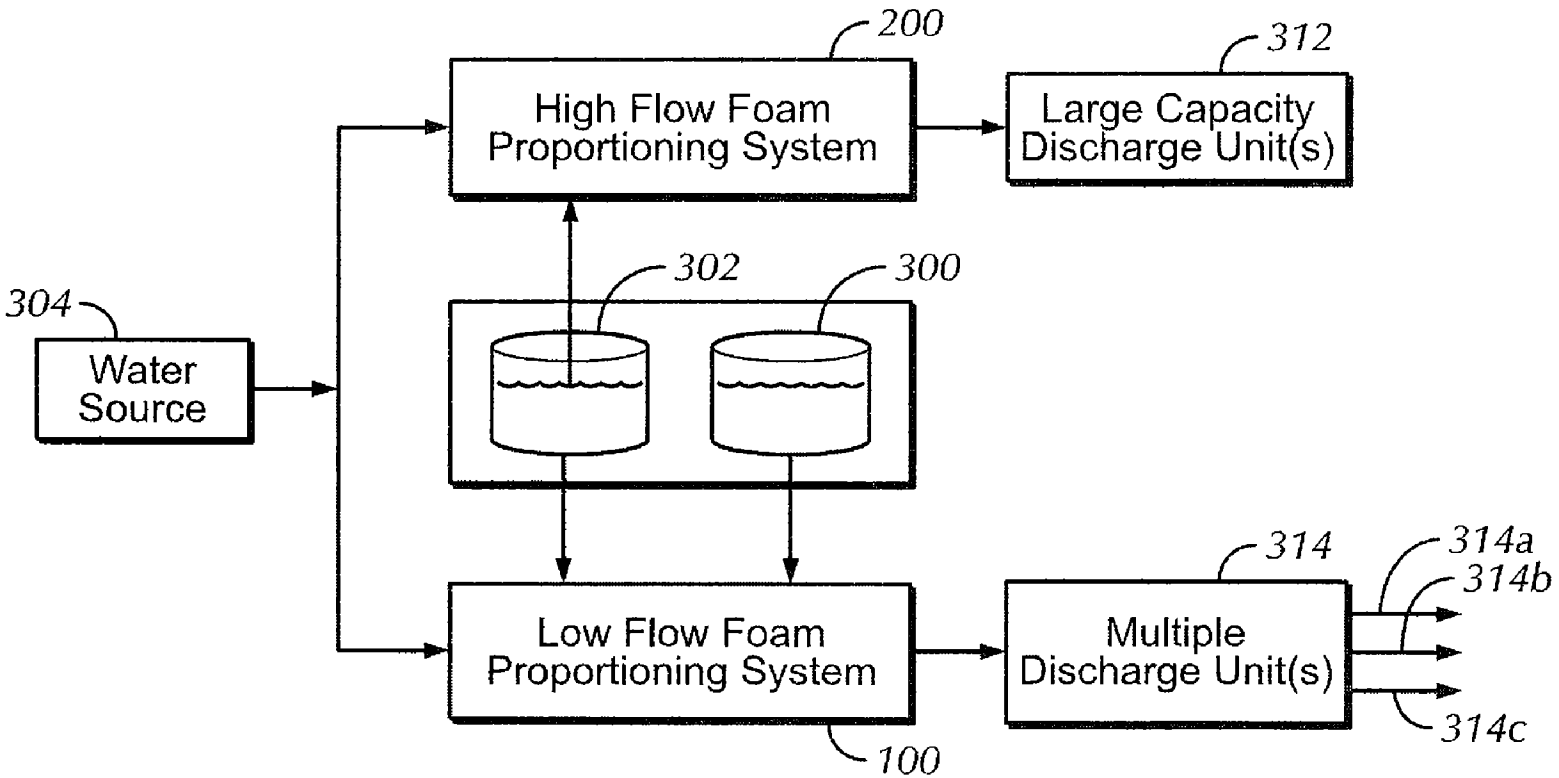
FIG. 11 is a schematic illustration of another embodiment of the hybrid foam system of the present invention illustrating large and multiple discharge units.

The discharge unit 308 can be any discharge unit such as fire hoses, nozzles, or the like or a series of such fire hoses. For the hybrid foam system 10 in a parallel configuration (as shown in FIG. 11), the discharge unit can include a large capacity discharge unit 312 (or a plurality of discharge units) connected to the high flow foam proportioning system 200 and a plurality of smaller discharge units 314*a*, 314*b*, 314*c* connected to the low flow foam proportioning system 100. Preferably, the smaller discharge units 314*a*, 314*b*, 314*c* are hoses with nozzles having an outlet diameter of about 2.5 inches.

Referring back to FIG. 4, in operation, for the hybrid foam system 10 in a parallel configuration, water is pumped through the hybrid foam system 10 by the water source 304. The hybrid foam system 10 can be set to operate only the low flow foam proportioning system 100, only the high flow foam proportioning system 200, or both the low flow 100 and high flow 200 foam proportioning systems. In operation of the high flow foam proportioning system 200, an operator can select to have plain water pumped through the high flow foam proportioning system 200 by operation of the control valve 202 and the bypass valve 208. Alternatively, the operator can select to have a foam solution pumped out by allowing the flow of water, completely or partially, through the venturi 204. This configuration advantageously provides significant benefits over conventional foam proportioning systems. For example, as shown in FIG. 3, both the low flow foam proportioning system 100 and the high flow foam proportioning system 200 outputs to a discharge unit 308. In this configuration, the low flow foam proportioning system 100 can operate in its normal mode and the fire fighting fluid flowing through the high flow foam proportioning system 110 can be water. However, if needed, additional Class B foam solution can be added to the discharge unit 308 by the high flow foam proportioning system 200. This advantageously allows for a high output volume of Class B foam for use on Class B fires which cannot be typically provided for by conventional Class A foam proportioning systems.

Referring back to FIG. 2, in operation, for the hybrid foam system 10 in a series configuration, water is pumped through the hybrid foam system 10 by the water source 304. An operator can then select to operate either the low flow foam proportioning system 100 or the high flow foam proportioning system 200 by way of valves (not shown). This configuration advantageously allows an operator to select the appropriate fire fighting fluid. That is, the hybrid foam system 10 can be used to provide water, Class A foam solution, or a Class B foam solution as necessary, all of which can be advantageously controlled automatically or semi-automatically through a system controller.

Figure 12:
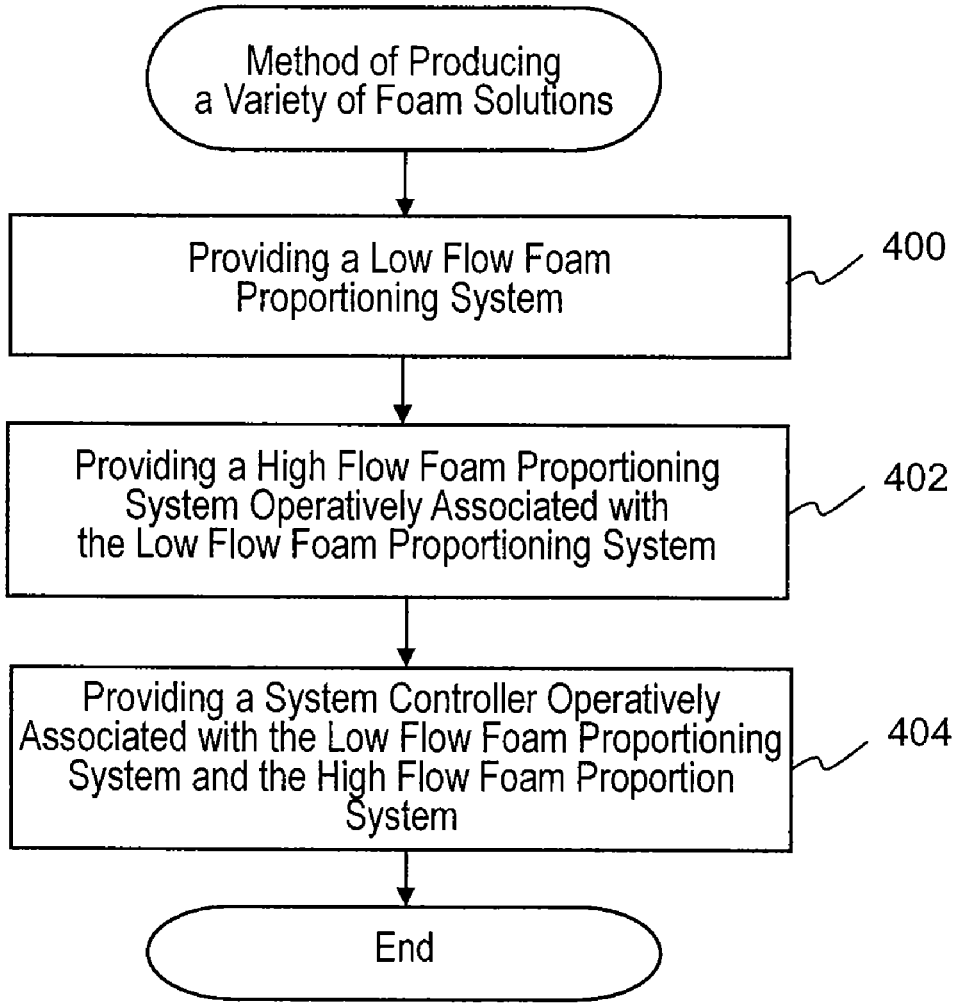
FIG. 12 is a flow chart of a method of producing a variety of foam solutions according to another embodiment of the present invention.

As shown in FIG. 12, the present invention also provides for a method of providing a variety of fire fighting solutions. The method includes the steps of providing a low flow foam proportioning system (Step 400), providing a high flow foam proportioning system operatively associated with the low flow foam proportioning system (Step 402), and providing a system controller operatively associated with the low flow foam proportioning system and the high flow foam proportioning system for controlling the operation of the low flow foam proportioning system and the high flow foam proportioning system (Step 404). The present method can further include the step of providing a set of stored instructions for the system controller for automatically controlling the operation of the low flow foam proportioning system 100 and the high flow foam proportioning system 200 to maintain operations within normal processing parameters.

From the foregoing, it can be seen that the present invention provides for an apparatus for a hybrid foam system and methods thereof. It will be appreciated by those skilled in the art that changes could be made to the embodiments described above without departing from the broad inventive concept thereof. It is understood, therefore, that this invention is not limited to the particular embodiments disclosed, but is intended to cover modifications within the spirit and scope of the present invention as defined by the appended claims.

We claim:

1. A hybrid foam system comprising:

a low flow foam proportioning system that mixes foam and water, the low flow foam proportioning system includes:
- a first conduit for receiving a supply of water at an inlet,
- a foam pump in fluid communication with the first conduit,
- a selector valve having:
  - a first inlet connected to a first foam tank,
  - a second inlet connected to a second foam tank, and
  - a selector valve outlet in fluid communication with the foam pump, and
- an outlet of the first conduit positioned downstream the foam pump; and a high flow foam proportioning system that mixes foam and water, the high flow foam proportioning system comprising:
- a second conduit for receiving a supply of water at an inlet, a venturi based foam proportioner for introducing foam into the second conduit, a bypass conduit having:

an inlet in fluid communication with the second conduit and positioned upstream of the venturi based foam proportioner, and an outlet in communication with the second conduit and positioned downstream of the venturi based foam proportioner, wherein the high flow foam proportioning system is operatively associated with the low flow foam proportioning system;

a water source connected to the inlet of the first conduit and the inlet of the second conduit to supply water to the low flow foam proportioning system and the high flow foam proportioning system, respectively;

a system controller operatively in communication with the low flow and the high flow foam proportioning systems; and a discharge unit in communication with the low flow and the high flow foam proportioning systems.

2. The hybrid foam system of claim 1, wherein the system controller is operatively in communication with the venturi based foam proportioner.

3. The hybrid foam system of claim 1, wherein the high flow foam proportioning system further comprises at least one of an inlet flow sensor, an inlet pressure sensor, and an outlet pressure sensor, connected to the venturi based foam proportioner and in communication with the system controller.

4. The hybrid foam system of claim 1, wherein the high flow foam proportioning system further comprises a control valve connected to the venturi based foam proportioner and a bypass valve connected to the bypass conduit.

5. The hybrid foam system of claim 4, wherein the venturi based foam proportioner includes a foam inlet valve.

6. The hybrid foam system of claim 1, wherein the selector valve and the foam pump is operatively associated with the system controller.

7. The hybrid foam system of claim 1, wherein the low flow foam proportioning system further comprises a water flow sensor connected to the first conduit and in communication with the system controller.

8. The hybrid foam system of claim 1, wherein the low flow foam proportioning system and the high flow foam proportioning system are connected in series or in parallel.

9. The hybrid foam system of claim 1, wherein the system controller is a programmable logic controller or a computer.

10. The hybrid foam system of claim 1, wherein the system controller further comprises a set of stored instructions for automatically controlling the low flow and high flow foam proportioning systems.

11. The hybrid foam system of claim 1, wherein the venturi based foam proportioner includes a foam inlet valve in communication with at least one of the first and the second foam tanks.

12. The hybrid foam system of claim 1, wherein the venturi based foam proportioner comprises:

a converging section;

a diverging section;

a vena contracta; and a piston configured to move axially along the diverging section.

13. A method of producing a variety of foam solutions comprising the steps of:

providing a low flow foam proportioning system that mixes foam and water, the low flow foam proportioning system includes:

a first conduit for receiving a supply of water at an inlet, a foam pump in fluid communication with the first conduit, a selector valve having:

a first inlet connected to a first foam tank, a second inlet connected to a second foam tank, and a selector valve outlet in fluid communication with the foam pump, and an outlet of the first conduit positioned downstream the foam pump; and providing a high flow foam proportioning system that mixes foam and water, the high flow foam proportioning system comprising:

a second conduit for receiving a supply of water at an inlet;

a venturi based foam proportioner for introducing foam into the second conduit, a bypass conduit having:

an inlet in fluid communication with the second conduit and positioned upstream of the venturi based foam proportioner, and an outlet in communication with the second conduit and positioned downstream of the venturi based foam proportioner, wherein the high flow foam proportioning system is operatively associated with the low flow foam proportioning system;

providing a supply of water to the inlet of the first conduit and to the inlet of the second conduit;

providing a system controller operatively associated with the low flow and high flow foam proportioning systems for controlling the operation of the low flow and high flow foam proportioning systems; and providing a discharge unit in communication with the low flow and the high flow foam proportioning systems.

14. The method of claim 13, further comprising the step of providing a set of stored instructions for the system controller for automatically controlling the operation of the low flow foam proportioning system and the high flow foam proportioning system.

* * * * *